United States Patent [19]

Caudill et al.

[11] 4,304,273

[45] Dec. 8, 1981

[54] TONER CONTAINER AND TONER DISPENSING APPARATUS

[75] Inventors: Allison H. Caudill, Lafayette; Lowell M. Simson, Louisville; James W. Stanley, Boulder, all of Colo.

[73] Assignee: International Business Machines Corporation, Armonk, N.Y.

[21] Appl. No.: 108,765

[22] Filed: Dec. 31, 1979

[51] Int. Cl.[3] ..... B65B 1/04; B65B 3/04

[52] U.S. Cl. ..... 141/268; 141/364; 222/238; 366/271

[58] Field of Search ..... 141/1, 11, 12, 250–284, 141/363–366, 311 R; 222/226–248, 406, 407, 414, DIG. 1; 366/271; 118/608, 610, 612, 653

[56] References Cited

U.S. PATENT DOCUMENTS

| | | | |
|---|---|---|---|
| 604,937 | 5/1898 | Irish | 141/268 |
| 1,822,557 | 9/1931 | Beatton | 141/268 |
| 3,325,844 | 6/1967 | Lampe | 141/364 |
| 3,647,293 | 3/1972 | Queener | 355/15 |
| 3,834,808 | 9/1974 | Takahashi et al. | 355/3 R |
| 3,999,514 | 12/1976 | Abbott et al. | 118/657 |
| 4,018,187 | 4/1977 | Abbott et al. | 118/658 |
| 4,026,336 | 5/1977 | Spies | 141/348 |
| 4,060,105 | 11/1977 | Feldeisen et al. | 141/1 |
| 4,062,385 | 12/1977 | Katusha | 141/364 |
| 4,133,458 | 1/1979 | Bundy | 222/238 |
| 4,161,923 | 7/1979 | Abbott et al. | 118/658 |

OTHER PUBLICATIONS

IBM Tech. Disc. Bull., vol. 17, No. 12, May 1975, "Variable Quantity Toner Replenisher", by A. H. Caudill, W. F. Risedorf and J. A. Thompson, pp. 3516–3517.

IBM Tech. Disc. Bull., vol. 20, No. 11B, Apr. 1978, "Toner Replenisher with Rotating Top Cover", by A. H. Caudill, R. L. Nieto and J. M. Petrovick.

*Primary Examiner*—Houston S. Bell, Jr.
*Attorney, Agent, or Firm*—Francis A. Sirr

[57] ABSTRACT

A magnetic brush developer having a toner dispenser cooperable with a removable toner container of the bottle type so that transfer of toner to the dispenser occurs without spillage or exposure of the toner to the external environment. The bottle and dispenser have mating interfaces which must be properly located, and then rotated, before dumping of toner from the bottle to the dispenser can occur. The dispenser interface is positioned in a slidable cover so that the bottle's toner content can be evenly distributed along the length of the dispenser, this length corresponding substantially to the length of the developer's development zone.

25 Claims, 9 Drawing Figures

TONER CONTAINER AND TONER DISPENSING APPARATUS

TECHNICAL FIELD

The present invention pertains to the field of toner replenishment in a xerographic copier.

BACKGROUND OF THE INVENTION

In a xerographic device, such as a copier, a photoconductor's latent image is subjected to the influence of a developer whereat toner is deposited on the latent image. Since toner is a consumable constituent of the xerographic process, it must be continuously supplied to the developer in a controlled manner, usually by way of a toner dispenser.

The dispenser portion of a xerographic developer stores a supply of virgin toner which is periodically metered to the developer, in a controlled fashion, during copier use. This control of toner metering can be accomplished open-loop, for example as a function of copier usage, or it can be accomplished closed-loop by a toner concentration sensing device which operates to meter toner as a function of the quantity of toner which is sensed to be in the developer. In either arrangement, it is periodically necessary to restock virgin toner in the developer's replenisher.

Typically, the replenisher takes the form of an elongated bin and an elongated metering roller which spans the length of the developer's development zone, this zone being a function of the width of the photoconductor to be developed. Other replenishers may comprise a bin located at one point, for example one end, along the developer's length. In this case a toner transport device, such as an auger, is used to evenly distribute virgin toner along the developer's development zone.

The problem of dispensing flowable material, such as xerographic toner, has been addressed in a variety of ways by the prior art.

For example, U.S. Pat. No. 3,834,808 addresses the problem of loading toner to a developer from a bottle-like container by providing two relatively movable concentric cylinders. The inner cylinder is stationary and includes an upward facing opening which is adapted to receive toner from the inverted bottle. The outer cylinder rotates so that its cooperating opening can be positioned facing down, for attachment of an upright toner bottle. After such attachment, the outer cylinder is rotated 180° so that the attached toner bottle is inverted as it is brought into alignment with the opening of the inner cylinder.

U.S. Pat. No. 4,026,336 provides an arrangement for dispensing dry granular or powdered, material, such as salt, etc., from a bulk storage container to a receptacle container wherein external isolation is provided during material transfer. More specifically, the dispensing portion of the bulk storage container includes a projecting stationary inner sleeve which includes dispensing ports. A telescoping outer sleeve normally closes these ports. When the bulk storage container is inverted, and then pressed into an upward-facing opening in the receptacle container, the storage container's telescoping sleeve is obstructed by a cooperating portion of the storage container. As a result, the telescoping sleeve remains stationary as the inner sleeve penetrates the receptacle container, thereby opening the dispensing ports to the receptacle container. The receptacle container may include a self-closing member for its upward facing opening.

U.S. Pat. No. 4,060,105 discloses a toner bottle whose body portion includes a D-shaped opening adapted to communicate with a similar D-shaped opening formed in a rotatable bottle cap. This cap is carried integrally with the bottle such that the bottle is sealed when these D-shaped openings are not aligned. Rotation of the cap by 180° opens the bottle. A cooperating toner hopper removably receives the closed and inverted bottle. This hopper includes a D-shaped, upward facing opening having a lip which mates with the D-shaped opening in the bottle's rotatable cap. Rotation of the bottle by 180° opens the bottle and its toner dumps to the hopper. The bottle's body portion includes locating lugs which are operable to locate the bottle as it is inverted into the hopper's bottle-receiving collar, and to lock the bottle to the collar after 180° rotation of the bottle. The bottle's body portion also includes a stopping lug which hits a collar-supported stop when the bottle has been rotated 180°.

The IBM TECHNICAL DISCLOSURE BULLETIN of April 1978, at pages 4708 and 4709, describes a toner replenisher arrangement in which a bottom-unloading cartridge is moved into place on top of a replenisher bin. In so moving, the cartridge causes the bin's upward-facing accordian door to open. Thereafter, a cartridge seal is removed and toner dumps to the bin. When the empty cartridge is to be replaced, the upper portion of the bin, which holds the cartridge, is pivoted 180° so that the cartridge can be removed with its opening now facing upward.

SUMMARY OF THE INVENTION

The construction and arrangement of the present invention provides a low cost clean-load feature for the toner dispenser of a xerographic developer.

The toner container of the present invention comprises a low cost bottle having an openable/closable cap, such that the bottle is open only when it is attached to the developer's replenisher bin. Similarly, the replenisher bin of the present invention is open only when an open toner bottle is attached thereto. Thus, no toner can escape to the atmosphere during attachment or detachment of the toner bottle.

The present invention also includes a movable cover for the developer's replenisher bin, such that the attached and open toner bottle may be moved the length of the replenisher bin to distribute the toner along this length in a manner which prevents escape of toner to the atmosphere.

With the arrangement of the present invention, the toner bottle can either be left in place on the replenisher cover during copier operation, or it can be emptied and removed. The former use allows the bottle's toner capacity to be used to increase the toner capacity of the replenisher bin.

The foregoing and other features and advantages of the invention will be apparent from the following more particular description of preferred embodiments of the invention, as illustrated in the accompanying drawing.

DESCRIPTION OF THE PREFERRED EMBODIMENTS

The present invention will be discussed in the environment of a xerographic device having a drum shaped photoconductor; however, it is not to be limited thereto.

Figure 1:
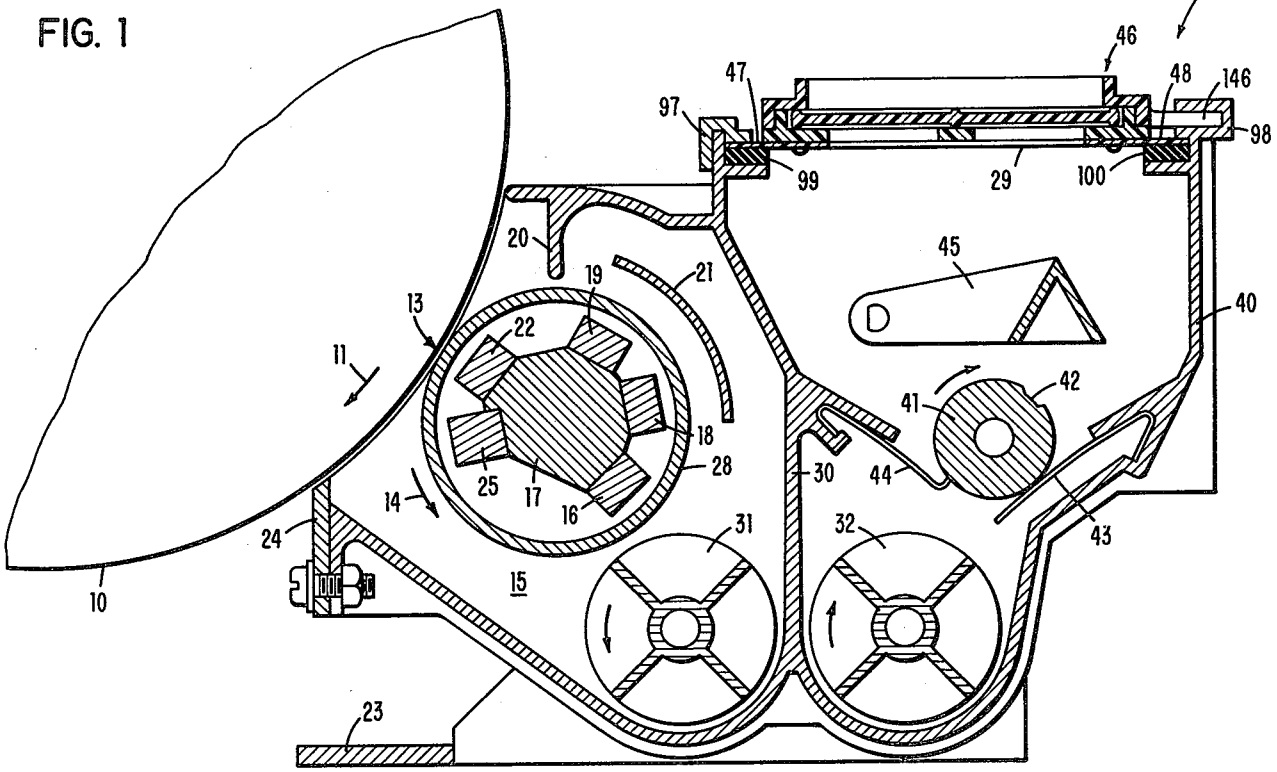
FIG. 1 is a side view of the development nip formed by a drum photoconductor of a xerographic device and a magnetic brush developer, the developer having a toner replenisher which incorporates the present invention.

In FIG. 1 a portion of such a drum photoconductor of, for example, six inches in diameter is identified by reference numeral 10. During operation, this drum rotates at a constant speed in direction 11. Magnetic brush developer 12 is located such that a line drawn between the center of drum 10 and the center of developing roll 28 makes an angle of approximately 31° to the horizontal. The developing nip is formed at 13 and comprises a gap of uniform dimension of approximately 0.04 inch, as measured along the above-mentioned center to center line. This gap has an axial length, measured parallel to the rotational axes of drum 10 and roll 28, of approximately 9.5 inches. In operation, roll 28 rotates at a constant surface velocity, approximately four times the surface velocity of drum 10, and in direction 14.

Details of the magnetic brush developer do not constitute a limitation on the present invention. This developer may be of the type disclosed in U.S. Pat. Nos. 3,999,514 and 4,161,923, incorporated herein by reference. In an exemplary arrangement, this magnetic brush developer has been used in a xerographic device of the combined developing-cleaning type disclosed in U.S. Pat. No. 3,647,293, incorporated herein by reference.

Developer 12 performs the function of depositing toner on the photoconductor's electrostatic image. This is done by transporting a carrier-toner mix into contact with the photoconductor at nip 13. The carrier portion of the mix comprises approximately 1800 grams of PTFE-coated steel beads of 200$\mu$ diameter. The toner used is a dual classified toner, wherein particles below 5$\mu$ diameter and above 16$\mu$ diameter have been removed.

Carrier mix is picked up from the developer's sump 15 and is held on the surface of longitudinally grooved aluminum roll 28 by a strong pickup magnet 16. The aluminum roll rotates counterclockwise about a stationary magnetically permeable core 17. U.S. Pat. No. 4,018,187, incorporated herein by reference, discloses such a grooved aluminum roll.

Transport magnets 18 and 19 hold a heavy coating of carrier beads on the surface of roll 28 as they are lifted to the top of the roll. Doctoring blade 20 levels the roll's carrier coating to a thickness of approximately 0.08 inch as it passes under the blade moving toward the photoconductor. The excess carrier accumulates against the blade and passes over overflow plate 21 back into the developer sump. This overflow plate allows a large tolerance on the pickup magnet's strength and the doctor blade's position setting, and still maintains acceptable carrier flow to the photoconductor.

Carrier that passes under the doctor blade is controlled by developing magnet 22 which forms the magnetic brush. Roll 28's rotation pulls the beads downward between the photoconductor drum and the roll. Nip 13 is a critical developer adjustment, and is set in position with a drum gauge, whereby developer stop 23 is positioned and tightened as required to effect the proper positioning. Lower developer seal 24 is also adjusted with a drum gauge.

A source of development electrode voltage, not shown, is connected to roll 28 and cooperates with the photoconductor's latent image voltages to achieve development of this latent image. This voltage is nominally 250 volts negative, and since the photoconductor's image voltage is more negative (800 volts negative for an all-black image), positively charged toner is attracted to the image during development. A strong scavenge magnet 25, located below the development magnet, pulls the toner-depleted carrier back into the developer, where it is thrown off into the sump.

Figure 2:
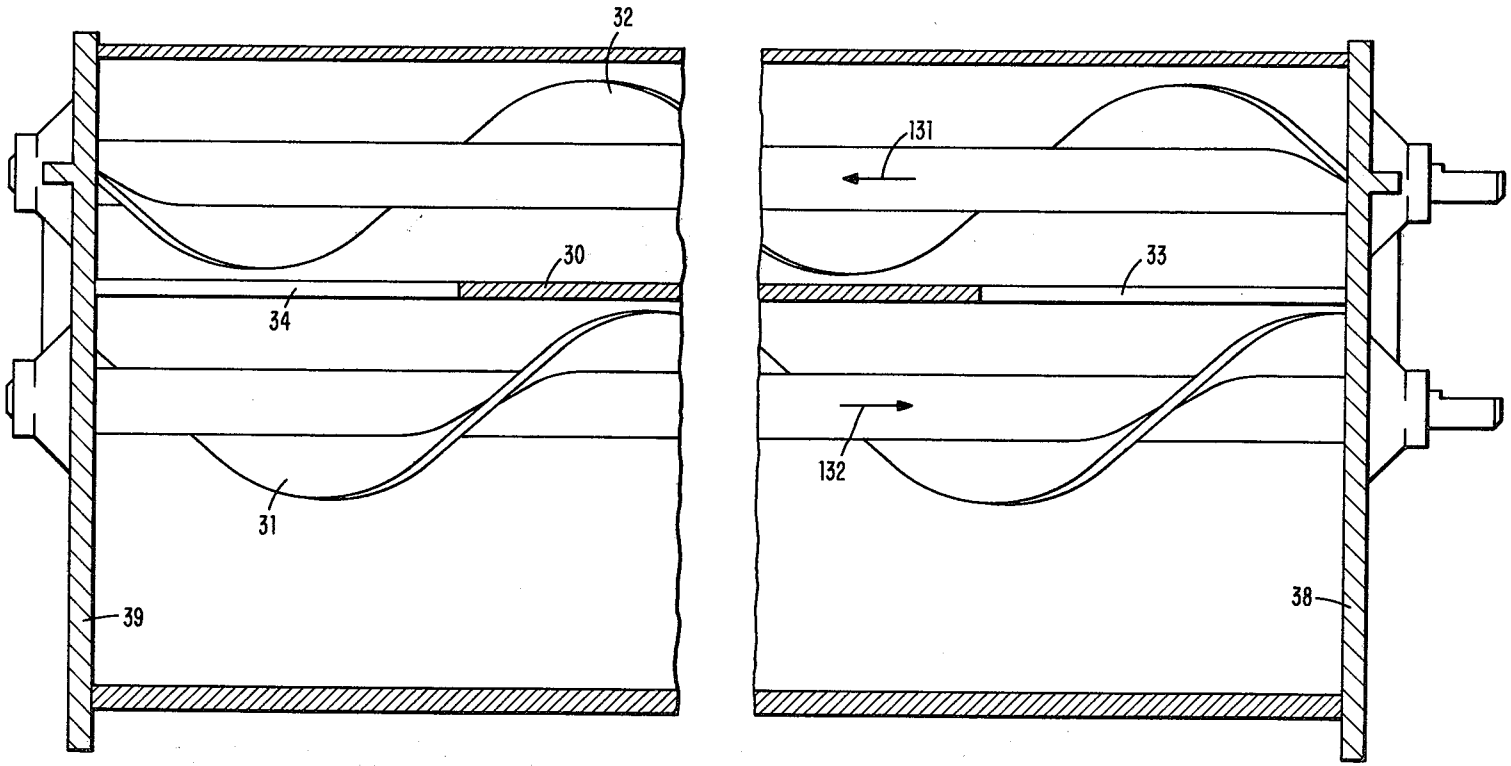
FIG. 2 is a schematic top view of FIG. 1's supply and return augers to illustrate the orbital flow of toner/carrier mix through the developer.

Augers 31 and 32 are used to circulate and mix the carrier with toner within the sump. A supply auger 31 moves the carrier longitudinally under roll 28 toward one end of the developer. Concurrently, the toner-depleted mix which is thrown off roll 28 is mixed with carrier in the sump. Two windows 33 and 34 (see FIG. 2) in partition 30, one window being at each end of the augers, allow the mix to flow in an orbital manner in sump 15, represented by FIG. 2's arrows 131 and 132. Return auger 32 must mix-in virgin toner as the mix moves along the developer's length. The mix then moves through window 34 in partition 30, to the starting point of supply auger 31.

Roll 28 is approximately 1.75 inches in diameter, 9.5 inches in axial length, and is driven by an electric motor, not shown, so long as the xerographic device is in the process of making copies. Augers 31 and 32 are approximately 1.5 inches in diameter, are of approximately the same axial length as roll 28, and are similarly driven so long as copies are being made. Augers 31 and 32 are constructed and arranged to rotate on axes parallel to the axis of roll 28, and to circulate the mix through its FIG. 2 orbital path approximately once for every two revolutions of drum 10. Preferably, these augers are formed of a plastic material having a low affinity for toner.

Developer 12 includes a toner replenisher 40, the operation of which drops virgin toner onto the top of auger 32, to thereby replace toner which is carried out of the developer on the photoconductor's latent image.

This operation is accomplished through a combination of the xerographic device's logic (not shown), which supplies a signal indicating a need to add virgin toner, and a mechanical assembly which meters toner into the sump in response to the signal.

The metering mechanism (not shown and not being a part of this invention) may be a pawl and ratchet device which drives toner metering roll 41 intermittently, as dictated by the device's logic. For example, a solenoid actuated clutch is picked at different intervals and for varied amounts of time, thereby varying the time metering roll 41 is driven and toner is added.

Metering roll 41 is a solid cylinder of polycarbonate plastic, with a longitudinal groove 42 which runs against a pair of scraping blades 43 and 44. As metering roll 41 rotates clockwise, toner fills groove 42 and sealing scraper blade 43 allows only the toner in the groove to leave the replenisher bin, to be added to the mix in the sump. As metering roll 41 continues to rotate, cleaning scraper blade 44 removes all toner from groove 42.

An exemplary arrangement of this type, which is incorporated herein by reference to illustrate the state of the art, is that of the IBM TECHNICAL DISCLOSURE BULLETIN of May 1975, at pages 3516 and 3517.

The level of toner in replenisher bin is sensed by toner low sensor arm 45, which rides on the surface of the toner remaining in the bin. A cam (not shown) is attached to the end of metering roll 41 and operates to periodically lift sensor arm 45 to prevent settling of the sensor arm into the toner. When the toner has been depleted to a predetermined level, the sensor arm operates a switch which signals the operator of the need for toner replenishment.

This toner replenishment is accomplished by the construction and arrangement of the present invention whereby a closed bottle of toner is attached to the closed and slidable coupling mechanism 46 of dispenser 40.

Toner is resupplied to replenisher 40 through a clean-load system. Virgin toner is contained in closable bottles which are always sealed except when attached to mechanism 46. The closed bottle fits into an opening in mechanism 46. After the bottle is properly positioned in mechanism 46, both the bottle and mechanism 46 are opened, by rotating the bottle approximately 90°. The bottle's toner then dumps into replenisher bin 40. The bin is uniformly filled by sliding mechanism 46 back and forth along the developer, i.e. in and out of the view of FIG. 1. The bottle cannot be removed from mechanism 46 until it is again rotated, such that both the bottle and mechanism 46 are again closed and sealed.

Figure 3:
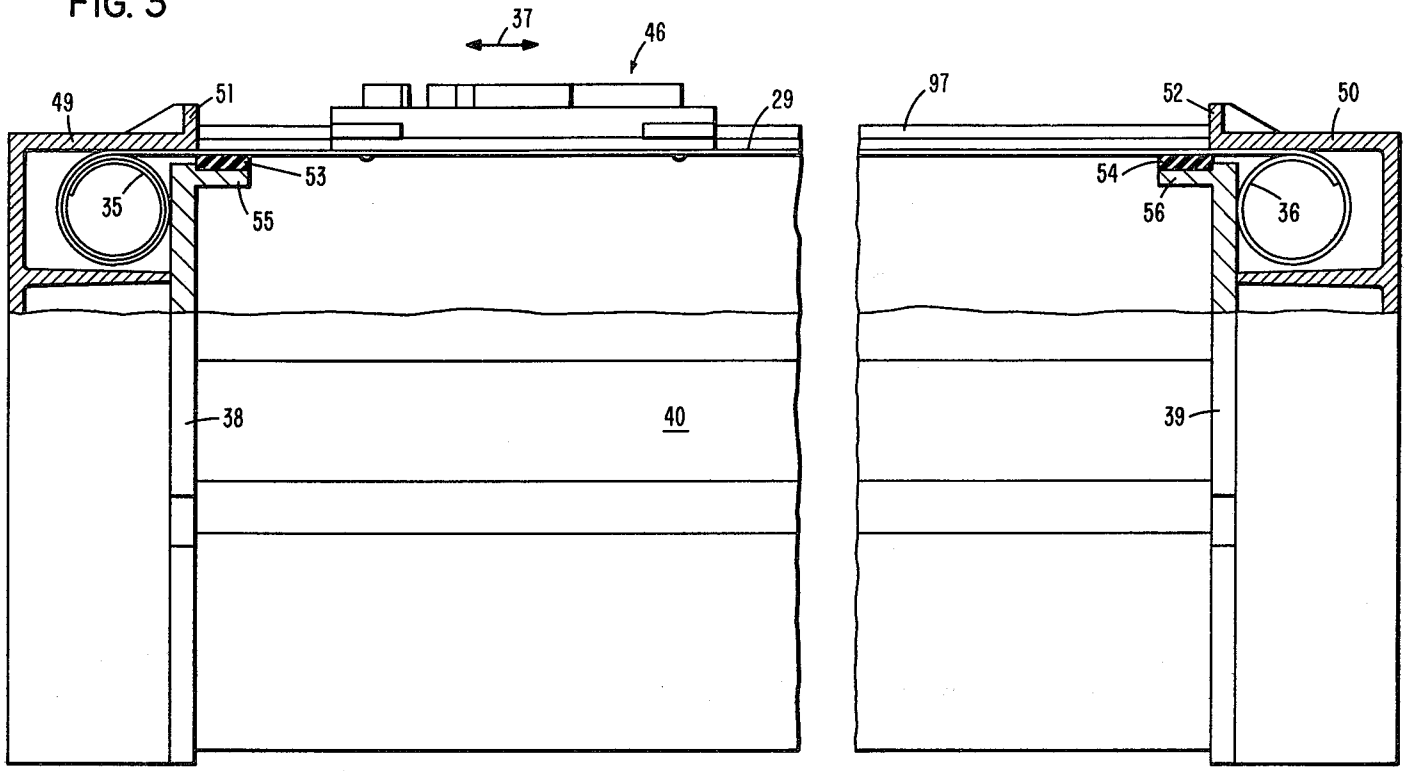
FIG. 3 is a right-side view of the developer of FIG. 1, showing the construction of the replenisher's movable cover.

As shown in FIG. 3, the dispenser's cover is formed by a thin, flexible band 29 preferably of polyester film having a 0.006 inch thickness. Opposite ends of this band are preform-coiled so as to form heat-set, coiled spring portions 35 and 36. These two coiled ends are stretched and snapped over the opposite end walls 38 and 39 of dispenser 40. The side edges 47 and 48 (FIG. 1) of the band which now extends between the two end walls are constrained for sliding movement only by means of overhanging guides 97 and 98. A point on the band between the two end walls mounts coupling mechanism 46 which removably receives a toner bottle. This coupling can be manually moved back and forth between the dispenser's end walls, as exemplified by arrow 37. The effect of the two end-disposed spring portions 35 and 36 is to establish an equilibrium force at all positions of coupling mechanism 46 through its range of movement between end walls 38 and 39. The dispenser's end walls are covered by decorative plastic covers 49 and 50. These covers carry band-guides 51 and 52. End walls 38 and 39 include stops 55 and 56 which limit the movement 37 of mechanism 46. The upper rectangular opening in dispenser 40 is sealed about its four sides by compression of a rectangular shaped rubber gasket having an upper polyester film skin which cooperates with band 29. In FIG. 3 the two end gaskets 53 and 54 are shown mounted on stops 55 and 56. In FIG. 1, the two side gaskets 99 and 100 are shown mounted on the two longitudinal walls of dispenser 40. Guides 51 and 52 (FIG. 3) and guides 97 and 98 (FIG. 1) force band 29 down onto these gaskets to provide a low-friction, sliding seal between the gaskets and band 29 during movement 37.

Figure 4:
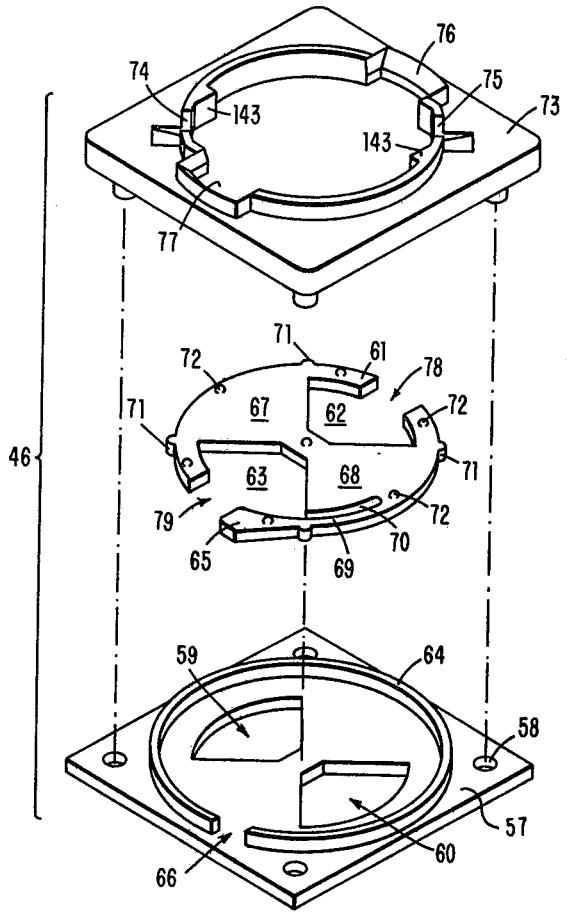
FIG. 4 is an exploded view of a first embodiment of FIG. 1's coupling mechanism.

The coupling mechanism 46, above described, is formed of three plastic members, one of which is a rotating valve member. A first embodiment of such a mechanism is shown in FIG. 4.

In this figure the lower member 57 includes a flat planar surface which mates with belt 29 and is fastened thereto by way of four openings 58 which are adapted to receive rivit fasterners, not shown. Two sector-shaped openings 59 and 60 align with similar openings in belt 29. In the alternative, belt 29 may be provided with a circular opening which receives annular wall 64, such that member 57 may be placed under the belt, the remaining portions of mechanism 46 being above the belt.

Valve disk 61 includes two similar sector-shaped openings 62 and 63. When disk 61 is placed within the area of member 57 which is defined by annular wall 64, the disk's detent arm 65 enters opening 66 in wall 64 when the disk is positioned such that openings 59 and 60 are closed by disk portions 67 and 68. As will be apparent, disk 61 can be rotated counterclockwise (as viewed in FIG. 4), whereupon the plastic extension 69 of arm 65 deflects inward, and openings 62, 63 are brought into alignment with openings 59, 60, respectively, as detent arm 65 rides on the inner surface of wall 64. The length of slot 70 determines the force necessary to release detent 65, 66. Substantially frictionless rotation of disk 61 is facilitated by bearing surfaces 71, 72 carrier integrally by disk 61.

Member 73 imprisons disk 61 within the confines of wall 64, as bearing surfaces 72 engage the planar underside of member 73. Member 73 includes a raised wall of smaller diameter than wall 64, and specifically of a diameter somewhat larger than the diameter defined by the outer annular extremities of sector shaped openings 59, 60 and 62, 63. This wall includes two voids 74 and 75 and two radial extensions 76 and 77. These four means 74–77 provide both location indicia and drive means cooperation between mechanism 46 and the toner bottle of FIG. 5, as will be apparent.

More specifically, the openings provided by radial extensions 76 and 77 are aligned with voids 78 and 79, respectively, in disk 61 when the disk is in its valve-closing position wherein disk portions 67, 68 close openings 59, 60, respectively. As will be apparent, voids 78, 79 are adapted to receive drive extensions of a toner bottle, such that counterclockwise rotation of the toner bottle moves disk 61 to its open position, as the bottle's drive extensions become imprisoned under member 73, thus locking the bottle to mechanism 46. During such rotation, voids 74, 75 cooperate with the bottle to open a bottom-disposed valve disk carried by the bottle.

Figure 5:
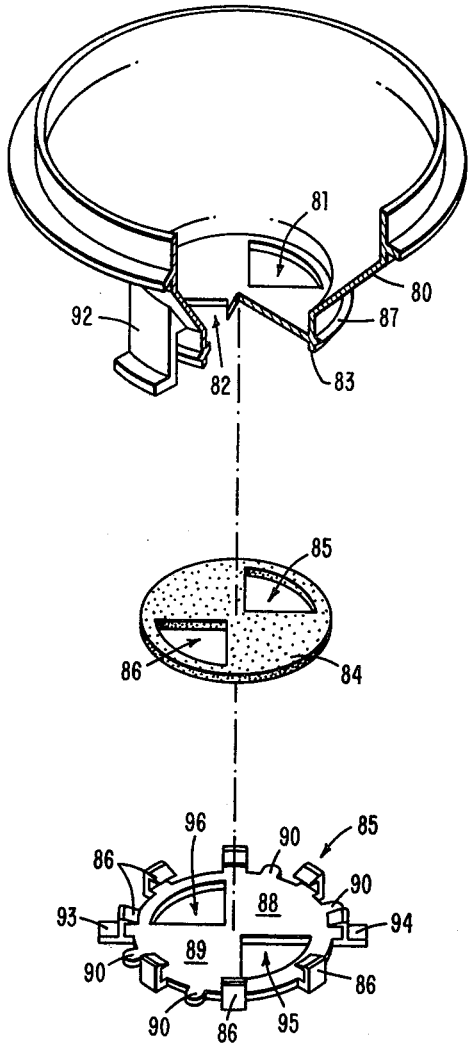
FIG. 5 is an exploded view of the portion of a toner bottle which cooperates with the coupling mechanism of FIG. 4.

FIG. 5 shows the construction and arrangement of the bottom portion of such a toner bottle.

The shape of the toner bottle is not to be considered a portion of the present invention; however, it is preferable that the lower portion include a funnel-like extension 80 so that manual tapping or squeezing will facilitate complete emptying of the toner into dispenser 40. In this connection, it is preferable that the upper portion of the bottle, not shown, be somewhat resilient. In the form shown in FIG. 5, the bottom of the toner bottle includes sector shaped openings 81 and 82 similar in size to the above-mentioned sector openings. These openings are surrounded by a continuous annular wall 83 which provides space for a gasket 84. Gasket 84, which may be a felt-like fabric, is glued in position with its sector-shaped openings 85, 86 in alignment with the bottle's openings 81, 82, respectively.

The bottle is closed by plastic valve disk 85. This disk is tightly held to bottle member 80 by way of eight resilient fingers 86 whose upper portions snap over the annular rim 87 provided in member 80. When disk 85 is so mounted, its portions 88 and 89 tightly close openings 81 and 82, respectively.

Figure 6:
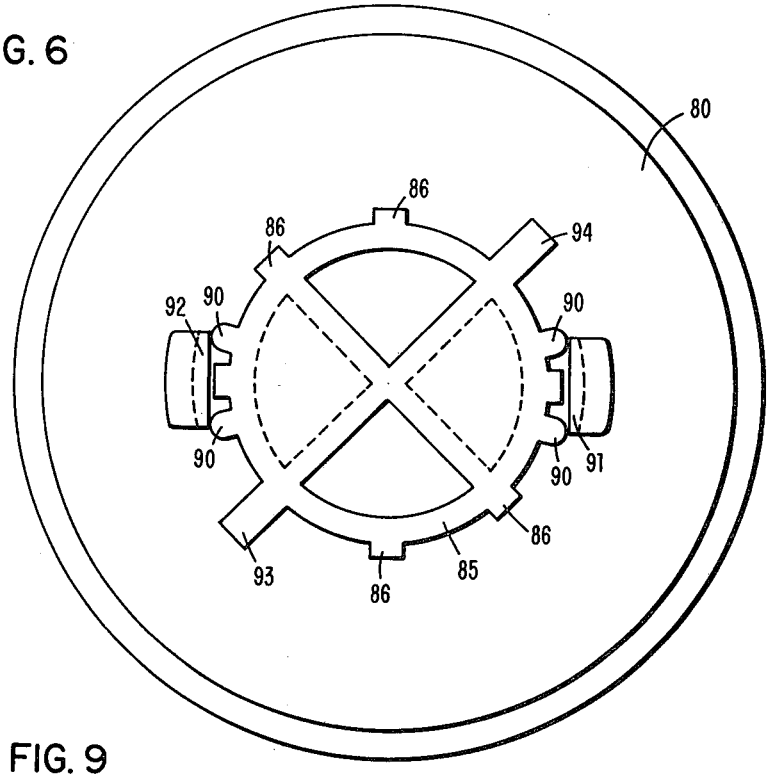
FIG. 6 is a bottom view of the toner bottle of FIG. 5, showing the detent mechanism which operates to hold the bottle's valving disk in a closed position.

As is apparent from FIG. 6, the disk includes detent projections 90 which cooperate with L-shaped drive extensions 91 and 92 formed in member 80 to hold disk 85 in its closed position. More specifically, detent projections 90 interfere with L-shaped extensions 91 and 92 during rotation of bottle member 80, and extensions 91 and 92 must flex radially outward to allow this rotation to occur. Thus, detent means 90, 91, 92 maintain the bottle closed.

When the toner bottle of FIG. 5 is mounted to the mechanism of FIG. 4, positioning extensions 93 and 94 formed integrally with disk 85 are positioned in voids 74 and 75, respectively, of member 73, as drive extensions 91 and 92 enter radial extensions 76 and 77, respectively, formed in member 73. After being mounted, counterclockwise rotation of the toner bottle simultaneously brings openings 60, 63, 95 and 82 into alignment, as openings 59, 62, 96 and 81 are brought into alignment. The bottle's toner content now dumps to dispenser 40, as mechanism 46 is moved back and forth (see arrow 37) to evenly distribute the toner along the length of metering roller 41 (FIG. 1).

Rotation of the bottle is limited to 90° by virtue of interference between drive extensions 91, 92 and stops 143.

It is preferable, but not essential to the present invention, that the toner bottle be immediately removed after emptying, such removal being preceded by clockwise rotation which closes both the bottle and mechanism 46.

Figure 7:
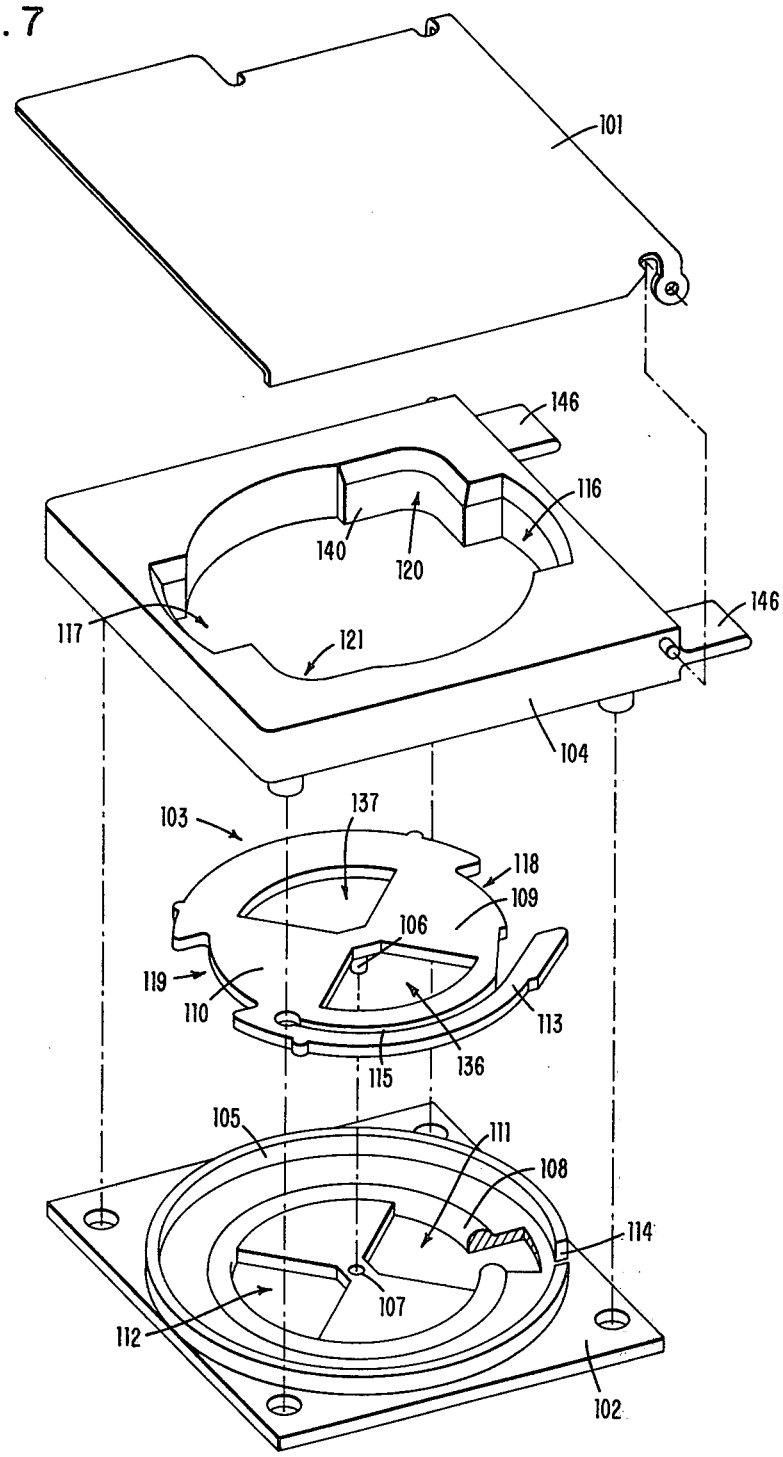
FIGS. 7 and 8 are embodiments of FIG. 1's coupling mechanism and a cooperating toner bottle, respectively, which are alternative to the embodiment of FIGS. 4 and 5.
Figure 8:
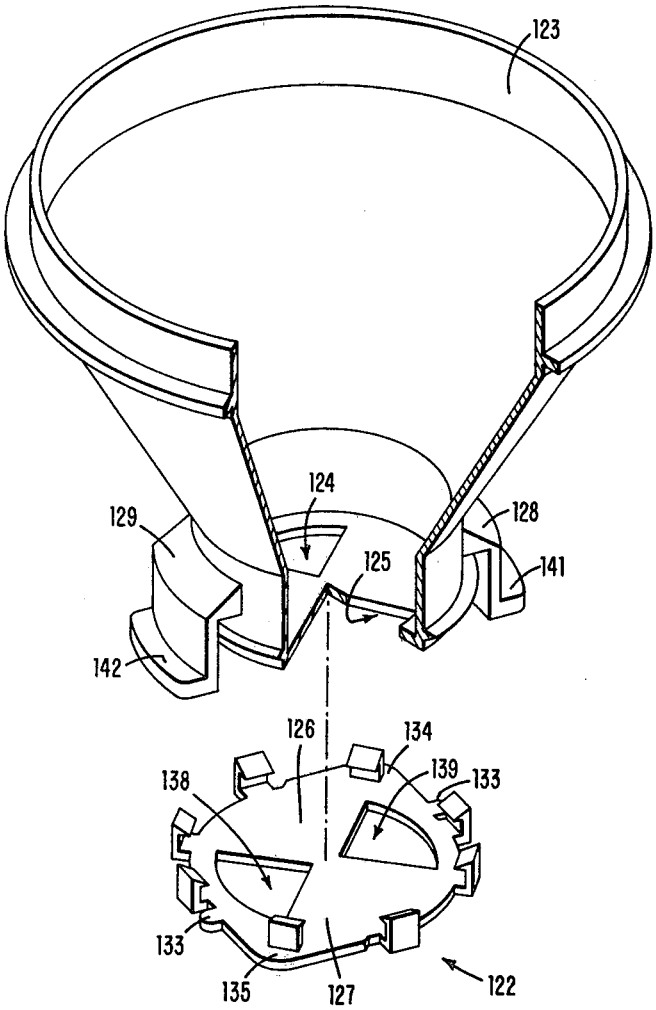

FIGS. 7 and 8 show a second embodiment of coupling mechanism 46 and a cooperating toner bottle, respectively.

The coupling mechanism of FIG. 7 includes a pivoted metal cover 101 which operates to cover the mechanism when a toner bottle is not in place thereon. The coupling mechanism per se again includes three plastic members 102, 103 and 104.

Member 102 includes a raised annular wall 105 which defines a cavity for valve disk 103. In this embodiment the valve disk includes an extending shaft 106 which defines its center of rotation. This shaft rotationally mates with an opening 107 formed in member 102. Member 102 includes an annular raised surface 108 which operates as a bearing surface and seal for disk 103.

When disk 103 is located within wall 105, and when it is in its closed position, so that its portions 109 and 110 cover sector opening 111 and 112, respectively, detent arm 113 is seated within the void 114 formed in wall 105. The length of slot 115 determines the force necessary to unlock detent 113, 114.

Member 104 imprisions disk 103 within wall 105. Extensions 116 and 117 in member 104's opening allow access to the valve disk's actuator slots 118 and 119, respectively. Extensions 120 and 121 in member 104's opening provide a positioning and holding means for the toner bottle's valve disk 122 of FIG. 8.

The toner bottle of FIG. 8 again is shown only partially in that the major portion of the bottle, above its cone-shaped bottom member 123 has been deleted from view. In this embodiment the bottom planar surface, which includes sector-shaped openings 124 and 125, is flat. This surface directly receives valve disk 122. Members 122 and 123 are plastic. Openings 124 and 125 are sealed by portions 126 and 127 of disk 122, respectively, by virtue of small continuous ridges, in the nature of flashing, which are carried by disk 122 and surround openings 124 and 125 when the disk is in position to close openings 124 and 125.

Member 123 includes lugs 128 and 129 which cooperate with two detent tabs 133 formed in disk 122. This detent means 133, 128, 129 operates to lock disk 122 in its closed position.

With disk 122 in its closed position, the toner bottle of FIG. 8 can be positioned within the opening of FIG. 7's member 104. When so positioned, portions 116 and 117 of member 104 receive the toner bottle's portions 128 and 129, respectively, as portions 120 and 121 receive the toner bottle's portions 134 and 135, respectively.

Clockwise rotation of the toner bottle (as viewed from above in FIG. 8) causes lugs 128 and 129 to drive valve disk 103 clockwise. Since valve disk 122 is held stationary during this rotation, the completion of 90° rotation, as limited by lug 129 hitting stop 140, brings openings 112, 136, 138 and 125 into alignment, as openings 111, 137, 139 and 124 are brought into alignment. The toner within bottle 123 now dumps into dispenser 40, the movement of mechanism 46 along the length of the dispenser evenly distributes the toner within the bin.

The L-shaped extensions 141 and 142 formed on lugs 128 and 129, respectively, now are held by overhanging portions of member 104 and operate to lock the toner bottle to the mechanism of FIG. 7 so long as the mechanism and the bottle are open.

Figure 9:
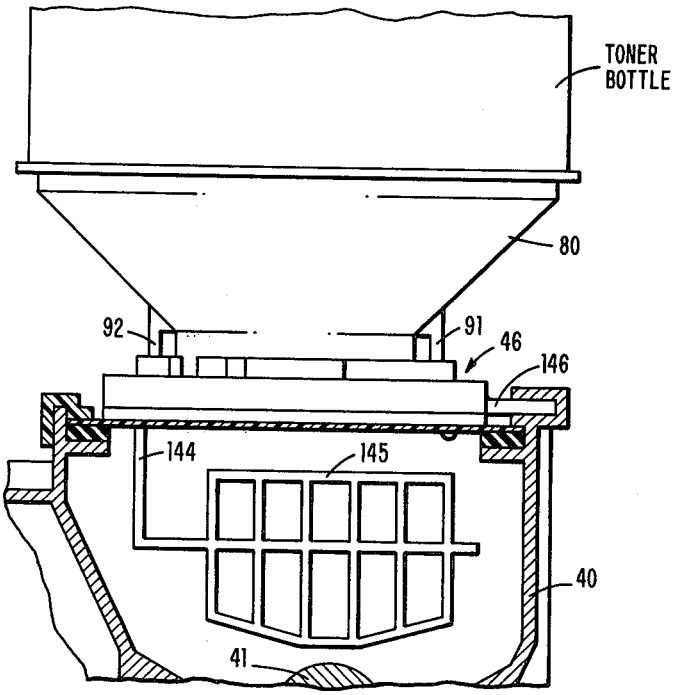
FIG. 9 shows a toner spreader and agitator which may be added to the mechanisms of FIGS. 4 and 7, respectively.

As a feature of the present invention, the mechanism 46 described primarily with reference to FIGS. 4 and 7 may include a toner spreader and agitator which is operable during movement 37 (FIG. 3) of mechanism 46. Such an arrangement is shown in FIG. 9 wherein the toner level sensor 45 of FIG. 1 has been eliminated, or more specifically it has been moved to provide room for the spreader. In this figure, mechanism 46 includes as an integral extension of its lower member (57 of FIG. 4 or 102 of FIG. 7) a plastic arm 144 which supports an open grid-like plastic toner spreader and agitator 145. As mechanism 46 moves back and forth (in and out of the view of FIG. 9), member 145 insures uniform toner distribution throughout bin 40 and also operates to prevent toner caking. Member 145 can be used to achieve these functions with or without the presence of the toner bottle.

As seen in FIGS. 1, 7 and 9, mechanism 46 preferably includes extending tabs 146 which cooperate with the dispenser's guide member 98 to hold and guide mechanism 46 during movement 37.

Within the scope of the present invention is a clean-load toner bottle/dispenser combination wherein the bottle and the dispenser are both individually maintained in a closed and sealed position.

The toner bottle includes a cylindrical cap, with a closed bottom including a drive member such as a protruding nut, and dispensing openings disposed about the lower periphery of its cylindrical wall. A cylindrical closure and valving member, open at both ends, surrounds the cap in axial, sliding relationship therewith. The closure member is sealed to the cap by slip-seal means such as two O-rings, one on each axial side of the dispensing openings, which are carried by the cap. A mechanical detent between the cap and the closure member normally maintains the closure member positioned over the cap's dispensing openings, and thus the bottle is securely closed.

The closure member includes three radially extending tabs which function as locating means whereby the toner bottle may be located on the dispenser's then-closed refill mechanism. After the bottle is properly located on the dispenser, the bottle is rotated to lock the bottle to the dispenser's refill mechanism, by operation of these tabs. A guide means is provided between the cap and the closure member to allow the closure member to axially slide on the cap, but prevents relative rotation from occurring.

The dispenser's refill mechanism includes an upward facing annular opening somewhat larger in diameter than the bottle's cap diameter. Surrounding this opening is an annular mounting member for the toner bottle. This mounting member includes radial slots to receive the bottle's three radially extending tabs. Subsequent rotation of the bottle captures these tabs in circumferential slots formed in this annular mounting member. The dispenser's annular opening is closed by a spring-biased, disk-like valve which is located within the dispenser and faces upward to engage and seal the underside of the annular opening. The upper face of this valve includes a drive member which mates with the drive member, formed in the closed bottom of the bottle cap, only when the bottle has been locked to the dispenser. The underside of this valve includes a centrally disposed, extending shaft which extends down into the dispenser and cooperates with a stationary portion of the dispenser to form a mechanical detent means to normally prevent opening of the valve. However, rotation of the bottle, to lock the same to the dispenser, simultaneously operates by virtue of the now-coupled drive means to rotate the valve and unlock this detent.

At this point, the bottle is locked to the dispenser and the dispenser's valve is unlocked. The bottle is now pushed down, causing its cap to penetrate the dispenser, and to push the dispenser's valve disk down to an open position, as the bottle's cylindrical closure member remains stationary. The downward movement of the bottle's cap, within the cylindrical closure member, exposes the cap's dispensing openings to the interior of the dispenser, and radial, gravity-assisted flow of toner occurs from the bottle to the dispenser.

While the invention has been particularly shown and described with reference to preferred embodiments thereof, it will be understood by those skilled in the art that various changes in form and details may be made therein without departing from the spirit and scope of the invention.

What is claimed is:

1. Apparatus for facilitating the transfer of flowable xerographic toner from a storage container to a copier's toner dispenser, comprising:

a toner container including a nozzle having first releasable shutter means and means normally maintaining said first shutter in a closed position;

a toner dispenser for holding a supply of toner in a compartment which has a dimension greater than that of said nozzle, and having a slidable, elongated cover which is slidable over said greater dimension, said cover including means for receiving said nozzle, said receiving means having second releasable shutter means normally maintained in a closed position; and means for opening said first and second shutter means upon attachment of said nozzle to said receiving means;

whereby attachment of said nozzle to said receiving means permits communication between said container and said dispenser, movement of said slidable cover thereafter allowing distribution of toner throughout said greater dimension of said compartment.

2. The apparatus of claim 1 including locating means carried by said toner container and said receiving means, such that manipulation of said locating means after said attachment effects said communication, and locking means operable to mechanically lock said toner container to said cover during said communication.

3. The apparatus of claim 2 wherein said means for normally maintaining said first and second shutter means in a closed position comprises mechanical detent means which is overcome by operation of said opening means after said attachment.

4. The apparatus of claim 3 wherein unlocking of said locking means, prior to removal of said toner container, resets said detent means.

5. The apparatus of claim 4 wherein said first and second shutter means comprise first and second valve disks which are aligned on a common axis after said attachment.

6. The apparatus of claim 5 wherein operation of said opening means is effected by rotation of said toner container on said common axis after said attachment.

7. The apparatus of claim 6 wherein one of said valve disks is rotated as said toner container rotates, and the other of said valve disks is held stationary as said toner container rotates.

8. The apparatus of claim 1 including toner stirring means operable with movement of said slidable cover and extending into said dispenser in cooperation with toner therein.

9. Apparatus for facilitating the transfer of flowable xerographic toner from a storage container to the elongated toner dispenser portion of a xerographic developer, comprising:

an elongated toner dispenser spanning a length of the developer, and having a slidable, elongated cover spanning substantially the length of said dispenser, said cover including at one point thereon means for receiving the storage container, said receiving means spanning a length of the developer which is shorter than the corresponding length spanned by said dispenser;

whereby attachment of the storage container to said receiving means permits communication between the storage container and said dispenser, movement of said slidable cover thereafter allowing distribution of toner throughout the length of said dispenser.

10. The apparatus of claim 9 wherein said means for receiving said storage container includes means for opening the storage container.

11. The apparatus of claim 10 including locking means effective to prevent removal of an open storage container from the receiving means.

12. The apparatus of claim 11 including means for closing said receiving means, and the storage container including means for opening said receiving means.

13. The apparatus of claim 12 wherein manually manipulation of the storage container after attachment thereof to said receiving means effects opening of both the storage container and said receiving means.

14. The apparatus of claim 13 including locking means effective to prevent removal of an open storage container from said receiving means.

15. The apparatus of claim 9 including toner stirring means operable by said slidable cover and cooperating with toner in said dispenser to agitate and level the toner.

16. The apparatus of claim 9 including cover means operable to cover said receiving means in the absence of the storage container.

17. A toner dispenser for use in supplying toner to a xerographic developer, comprising:

an elongated dispenser bin having bottom-disposed means operable to meter toner to the developer;

a top-disposed elongated opening;

a band of flexible material closing said opening, said band having coiled spring portions disposed at opposite longitudinal ends of said opening;

coupling means adapted to removably receive a toner container to resupply toner only to that portion of said bin which is immediately under said coupling means, said portion being less than the entire elongated bin; and means mounting said coupling means to said band in a manner to facilitate gravity-dump of toner to said bin, said coupling means being movable along the length of said bin to distribute the toner throughout the length of said bin, said spring portions providing force equilibrium at substantially all positions of said coupling means.

18. The toner dispenser defined in claim 17 including low-friction means slip-sealing said band to said top-disposed opening.

19. The toner dispenser defined in claim 18 wherein said coupling means includes openable valve means, and means whereby said valve means is opened by the presence of a toner container.

20. The toner dispenser defined in clain 19 including a toner container having openable valve means, said coupling means including means to open the container's valve means and to lock an open container to said coupling means.

21. The toner dispenser of claim 20 including guide means integral with said coupling means and operable to guide said coupling means from said dispenser during said movement along the length of said bin.

22. The toner dispenser of claim 17 including a toner agitator mounted for movement with said band and operable to stir toner within said bin during such movement.

23. Apparatus for facilitating the transfer of flowable xerographic toner from a storage container to a toner dispenser, comprising:

a toner container including a nozzle having first releasable closure means including first means normally maintaining said first closure means in a closed position;

a dispenser having upward-facing means for receiving said nozzle as said nozzle faces downward, said receiving means having second releasable closure means including second means normally maintaining said second closure means in a close position;

means including cooperating portions carried by said toner container and said receiving means operable to insure proper location of said toner container on the dispenser's receiving means; and means thereafter operable as a result of rotation of said toner container for mechanically locking said container to said dispenser to permit simultaneous operation of their respective closure means, and thereby clean-load communication between said container and dispenser with gravity assisted transfer of toner to said dispenser.

24. The apparatus of claim 23 wherein said first and second means normally maintaining closure are mechanical detents.

25. The apparatus of claim 24 wherein operation of said first and second closure means, and release of said detents, occur simultaneous with rotation of said toner container.

* * * * *